US006716119B1

(12) United States Patent
Weisz et al.

(10) Patent No.: US 6,716,119 B1
(45) Date of Patent: Apr. 6, 2004

(54) SPORTS BALL STRIKING TRAINING DEVICE

(75) Inventors: Johnathan Weisz, San Diego, CA (US); Richard LaPointe, San Diego, CA (US)

(73) Assignee: Pro Performance Sports, Inc., San Diego, CA (US)

( * ) Notice: Subject to any disclaimer, the term of this patent is extended or adjusted under 35 U.S.C. 154(b) by 0 days.

(21) Appl. No.: 10/289,489

(22) Filed: Nov. 6, 2002

(51) Int. Cl.[7] ..... A63B 63/00

(52) U.S. Cl. ..... 473/423; 473/428; 473/429; 473/575

(58) Field of Search ..... 473/419, 420, 473/421, 422, 423, 424, 425, 426–431, 575, 451; 273/331, 332, 333, 334, 335, 317.8, 329, 330

(56) References Cited

U.S. PATENT DOCUMENTS

| | | | | |
|---|---|---|---|---|
| 1,708,796 A | | 4/1929 | Lawrence | |
| 2,247,072 A | | 6/1941 | Stow | |
| 2,270,957 A | | 1/1942 | Mears | |
| 2,842,366 A | | 7/1958 | Fant | |
| 3,006,647 A | | 10/1961 | Haskett | |
| 3,166,316 A | | 1/1965 | O'Leary | |
| 3,341,200 A | | 9/1967 | Brandley | |
| 3,397,885 A | | 8/1968 | Nash, Jr. | |
| 3,550,937 A | | 12/1970 | Wright | |
| 3,764,140 A | | 10/1973 | Lotfy | |
| 3,994,494 A | | 11/1976 | Kelley | |
| 4,027,880 A | | 6/1977 | Hadtke | |
| 4,088,316 A | | 5/1978 | Szafianski | |
| 4,216,960 A | | 8/1980 | Nicholls | |
| 4,322,075 A | | 3/1982 | Hynes | |
| 4,415,155 A | | 11/1983 | Goudreau et al. | |
| 4,460,172 A | * | 7/1984 | Hogan | 473/426 |
| 4,462,599 A | | 7/1984 | Brown | |
| 4,576,379 A | | 3/1986 | Juhasz | |
| 4,664,375 A | | 5/1987 | Tetreault | |
| 4,679,790 A | | 7/1987 | Ham | |
| 4,815,735 A | | 3/1989 | McClenny | |
| 4,898,385 A | | 2/1990 | Love | |
| 4,966,367 A | | 10/1990 | Oyarzabal | |
| 5,048,828 A | | 9/1991 | Love | |
| 5,135,219 A | | 8/1992 | McKeon et al. | |
| 5,244,392 A | | 9/1993 | Maursetter | |
| 5,340,101 A | | 8/1994 | Lawson et al. | |
| 5,460,364 A | | 10/1995 | Ring | |
| 5,460,380 A | | 10/1995 | Ober | |
| 5,531,438 A | | 7/1996 | Corley | |
| 5,553,848 A | | 9/1996 | Amron | |
| 5,597,159 A | * | 1/1997 | Haygood et al. | 473/424 |
| 5,683,315 A | | 11/1997 | Ring | |
| 5,766,102 A | | 6/1998 | Lawson et al. | |
| 5,776,017 A | | 7/1998 | Brawn | |
| 5,882,270 A | | 3/1999 | Daugherty | |
| 6,033,323 A | * | 3/2000 | McCown | 473/424 |
| 6,296,582 B1 | | 10/2001 | Minniear | |
| 6,514,161 B1 | | 2/2003 | Minniear | |

FOREIGN PATENT DOCUMENTS

| | | |
|---|---|---|
| EP | 0 341 675 | 11/1989 |

* cited by examiner

*Primary Examiner*—Gregory Vidovich
*Assistant Examiner*—Nini F. Legesse
(74) *Attorney, Agent, or Firm*—Gordon & Rees LLP

(57) ABSTRACT

A sports ball striking practice device holds a variety of sports balls for striking practice purposes. The sports ball striking practice device includes a threadable tether, a rigid sleeve, a ball insert, and a sports ball. The ball insert is placed through the sports ball to form a channel having a sufficient diameter to accept the tether. The tether has a first end piece that is threadable through the rigid sleeve and the ball insert. The first end piece is attachable to a first strap. The tether has a second end piece with a permanent attachment to a second strap. The first and second straps are attachable to a pole or other similar upright object. The sports ball may be struck repeatedly by a striking device as the tether wraps and unwraps around a pole or other similar object.

18 Claims, 3 Drawing Sheets

SPORTS BALL STRIKING TRAINING DEVICE

FIELD OF INVENTION

This invention relates generally to sports ball striking practice devices, and more specifically to a striking practice device having a tether, a rigid or semi-rigid sleeve and ball insert assembly for holding a replaceable sports ball which may be struck repeatedly as the tether wraps and unwraps around a pole or a similar substantially vertical object.

BACKGROUND OF INVENTION

Practice devices for improving one's ability to strike balls are popular in the United States and throughout the world. These devices allow the user to practice without the help of another person by presenting the ball to the user for repeated striking. A variety of practice devices have been designed to hold balls of specific sports, including baseball, softball, tennis ball, hand ball, and racket ball with a striking instrument such as racket, bat stick, or one's hand.

These devices typically consist of a specific sports ball attached to an end of a tether or tethers, with the tethers attached in various configurations to a fixed object, such as a pole structure which may include complex operating mechanisms. These practice devices typically do not duplicate the normal striking position of the user and do not provide a realistic flight of a ball as it approaches the user. In addition, the prior art practice devices are often complex to manufacture, too expensive for purchase by sports enthusiasts, and/or bulky, hardware intensive, and inconvenient to set up.

While most devices attempt to prevent the sports ball from wrapping around the support structure, a few devices are designed specifically for wrapping the ball around a vertical or a horizontal pole. The ball winds and unwinds to present the ball to the user for repeated striking. These devices are inexpensive and relatively easy to set up. An example of a typical prior art tether device that employs the winding and unwinding of a ball is disclosed in U.S. Pat. No. 5,048,828 and U.S. Pat. No. 4,898,385, both to Love. The batting practice devices of the Love patents use two non-elastic rope materials as tethers. The ball is suspended from a first tether attached to a horizontal bar. A second tether is attached to a vertical bar at one end and to the first tether at a second end. The attachment point to the first tether must be adjusted to the desired striking height of the ball. The second tether acts to restrict the motion of the ball to wrap around the vertical pole.

U.S. Pat. No. 5,135,219 to McKeon et al. teaches a baseball batting practice using a first tethered rope attached to a horizontal bar at the upper end and attached to a ball at the lower end. A second tethered rope is spliced to the first tethered rope at a short distance above the ball, and is attached to a vertical bar to restrict lift of the ball. A sleeve extends from the ball to the splice to protect the tether. When a user hits the ball, it wraps around the vertical bar. The height of the ball is determined by the length of the first tether.

U.S. Pat. No. 4,322,075 to Hynes teaches the use of a first tether attached to a horizontal bar, and a second tether attached to a vertical bar. The ends of both tethers attach to the ball. The lengths of the tethers are minimized to restrict the amount of wrapping the occurs when the ball is hit. The ball height is adjusted by lowering or raising the horizontal bar.

U.S. Pat. No. 5,460,364 and U.S. Pat. No. 5,683,315, both to Ring, teach a portable horizontal bar that is attachable to an existing vertical pole. A ball is suspended from the horizontal bar by one or two tethers. When the ball is struck, the ball and tether(s) wrap around the horizontal bar. The ball height is controlled by the placement of the horizontal bar on the vertical pole.

The Baseball Striking Practice Device disclosed in U.S. Pat. No. 6,296,582 to Minniear (the '582 patent) includes significant improvements over patented devices as described above. The '582 patent features a practice ball slidably located upon a tether. The tether ends are attachable to a vertical pole or other similar support structure. The ball is slidably mounted to the tether and is positioned at a target position for striking by means of a ball positioner. The ball positioner is located on the tether in a fixed position that is either adjustable or permanent. Once struck during use, the practice ball and attached tether wrap around the support structure. The practice ball is aided in the return to the target position by forming the tether from elastic material which naturally biases the ball to unwind from the support structure for subsequent strike. The ball positioner of one embodiment disclosed in the '582 patent is a material swag which allows the ball to be adjusted to a desired height.

The prior art tether devices in which the ball is attached to one or two tethers presents disadvantages to a user. All of the above mentioned prior art devices do not provide for off-center, i.e., inaccurate hits. If a user mishits a ball, or misses the ball completely, the striking instrument is likely to make contact with one or both of the tethers. The hit to the tether results in the striking instrument becoming entangled in the tether, and a "dead" or "wild" ball that is dangerous or difficult to hit. The user must then catch the ball, reposition himself or herself, and reset the ball in motion. Thus, the striking practice is frustrating to the user and tedious to use.

Height adjustability is necessary for proper striking practice. The user may desire striking practice at varying heights. The prior art devices, with the exception of the '582 patent, do not provide convenient means for adjusting the ball after an initial adjustment. Although the material swag of the '582 provides easy adjustment of the ball, the material swag is likely to slip along the tether after repeated strikes of the ball causing a changing height of the ball.

The prior art striking practice devices typically require horizontal and vertical bars, attachment devices, and special tethering. These practice devices do not provide for replacement of any of the device components. The striking training devices currently available to the public eventually wear out, e.g., the ball begins to loose its shape, or the tether breaks. Once a component is not usable, the entire practice device must be replaced since, for example, the tethers are permanently attached to a strap or collar used for attachment of the device to the vertical supporting structure.

In view of the above described disadvantages, there still remains a need for an inexpensive, portable, sports ball striking device that maintains the feel of an untethered ball when struck but which also provides an extended hitting target to accommodate off-center hits. A further need remains for a device that provides a height-adjustable ball which retains its height once adjusted. Finally, a need remains for a striking practice device that is easily disassembled and assembled for replacement of the components of the assembly, e.g., replacement of the ball and the tether.

SUMMARY OF THE INVENTION

It is an advantage of the present invention to provide a sports ball striking training device that may configured to accept a variety of sports balls.

It is another advantage to provide a sports ball striking training device that provides a rigid or semi-rigid sleeve that acts as an extension of the sports ball for off-center strikes by the user.

Still another advantage is to provide a sports ball striking training device having a threadable cord assembly and a sports ball insert that allows the sports ball to be replaced or substituted.

It is yet another advantage to provide a ball insert device that provides a channel for a cord in the sports ball and which strengthens the sports ball for extended life/play.

It is still another advantage to provide a cam end piece which allows the cord to be released from the end piece for easy threading/re-threading of the cord through the rigid sleeve and sports ball or replacement sports ball.

In the exemplary embodiment of the present invention a sports ball striking training device is mountable on a substantially vertical object, such as a tree or pole, and simulates an opponent who is throwing, pitching, or returning a sports ball towards the user. The sports ball striking training device includes a conventional sports ball, a ball insert in the sports ball to provide a channel for a tether, a rigid or semi-rigid sleeve having two channel portions for accepting the tether, and strap assemblies for attaching the tether ends to a pole. The user strikes the sports ball causing the sports ball, sleeve and tether to wind around the pole. The ball reverses direction to unwind from the pole once the tether, sleeve and ball have wrapped completely around the pole. The tether and sleeve maintain the height of the sports ball such that the sports ball unwinds from around the pole to return to the same position from where it was struck by the user.

The sleeve of the exemplary embodiment of the sports ball striking training device consists of an elongated body having two channels for the tether and two arms extending from the elongated body that wrap at least partially around opposite sides of the sports ball. A hole is formed in the arms so that the tether is threadable through a path which includes the first channel of the rigid sleeve, a hole of the first arm, the channel through the ball, the hole of the second arm, and the second channel of the rigid sleeve. The tether suspends the sports ball between the arms of the rigid sleeve. The rigid sleeve acts to extend the hitting area of a ball for instances that the user strikes off-center on the ball. The rigid sleeve also prevents the striking instrument, such as a racquet or a bat, from getting entangled with the tether.

The rigid sleeve of the exemplary embodiment is manufactured to accept specific sports balls including baseballs, softball, tennis balls, racquet balls, hand balls, soccer balls, etc., by dimensioning the width between the sleeve arms to be slightly larger than the subject sports ball. Alternatively, the rigid sleeve may be configured to accept a variety of different diameter/circumference balls by providing inserts between the ball and the sleeve arms. In another embodiment, the sleeve arms are width-adjustable to accept balls of various widths. The sleeve is adjustable along the tether to allow the ball striking height to be adjusted. To raise the height of the ball, the upper tether is shortened, and to lower the height of the ball, the upper tether is lengthen by simply pulling the tether through the sleeve and ball. In the exemplary embodiment, the sleeve and ball channels are minimally larger than the tether so that frictional forces on the tether keep it from slipping in the sleeve and changing the ball height.

The exemplary embodiment of the sports ball striking training device utilizes a ball insert to form a channel through the ball for accepting the tether. Repeated striking of the eventually break down the ball, i.e., the ball loses its shape and the ball's performance declines. The addition of a channel that simply is drilled through the ball accelerates this break down. Specifically, the channel will collapse with repeated strikes of the ball, and the tether no longer freely slides through the ball. The ball insert of the exemplary embodiment not only extends the life of the sports ball, but also ensures that the tether remains slidable through the ball for purposes of adjusting the ball height and replacing the ball. The ball insert of the exemplary consists of a first portion for insertion into a first end of the ball channel, and a second portion for insertion into a second end of the ball channel. The first and second ball insert portions together may extend the length of the ball channel, or alternatively, may extend a less distance into the ball from either end of the channel. The first and second portions of the ball insert include a small lip to prevent the ball insert from slipping inside the ball during manufacture and/or during use of the sports ball striking training device. In another embodiment, for a single piece ball insert for use with a hollow core ball, the lip portion is utilized to seal the ball.

The strap assembly of the exemplary embodiment includes a strap that connects the sports ball striking training device to a vertical object, and end pieces that attach the ends of the tether to the strap. The strap of the exemplary embodiment is a nylon-based strap with velcro fasteners that may be wrapped tightly around the vertical object. The end piece of the exemplary embodiment is a self-cinching cam which accepts an end of the tether. To replace the sports ball, the tether is released from the cam and pulled through the first channel and arm of the sleeve and through the sports ball. The tether is threaded through the replacement ball, the arm and first channel of the sleeve and locked into the self-clinching end piece. The tether of the exemplary embodiment is made from a material that is elastic, but which maintains sufficient rigidity that allows the tether to be thread through the sleeve and sports ball.

In an alternate exemplary embodiment, at least one of the straps has an attached openable clasp. The openable clasp accepts an end piece that has an hole which hooks/inserts into the openable clasp. The end piece is slightly larger in diameter than the tether. In the alternate exemplary embodiment, the sleeve channels and ball insert are manufactured to have a larger diameter which allows the tether and end piece to thread through the sleeve and ball. In one embodiment, a polyurethane tubing is placed over the center section of the tether, that is, the section of the tether that runs through the sleeve and ball. The increase in diameter of the tether due to the tubing provides a tighter fit, and prevents the tether from slipping in the sleeve. In, another embodiment, rubber grommets adjacent the ball channel ends provide points with reduced diameters along the tether path which aid in preventing the tether from slipping.

The sleeve of the exemplary embodiment may be used alone with other tether/cord-type striking devices to improve the functionality of the striking devices by extending the striking area for off-center strikes of the sports ball. Similarly, the ball insert may be used to improve the performance of the sports balls used with other tether/cord-type striking devices. The use of "low profile" or self-cinching cams at the ends of the tether facilitates replacement of components of the striking training devices.

BRIEF DESCRIPTION OF THE DRAWINGS

The present invention will be better understood from the following detailed description of a preferred embodiment of the invention, taken in conjunction with the accompanying drawings in which like reference numerals refer to like parts and in which.

DESCRIPTION OF THE PREFERRED EMBODIMENT

Figure 1:
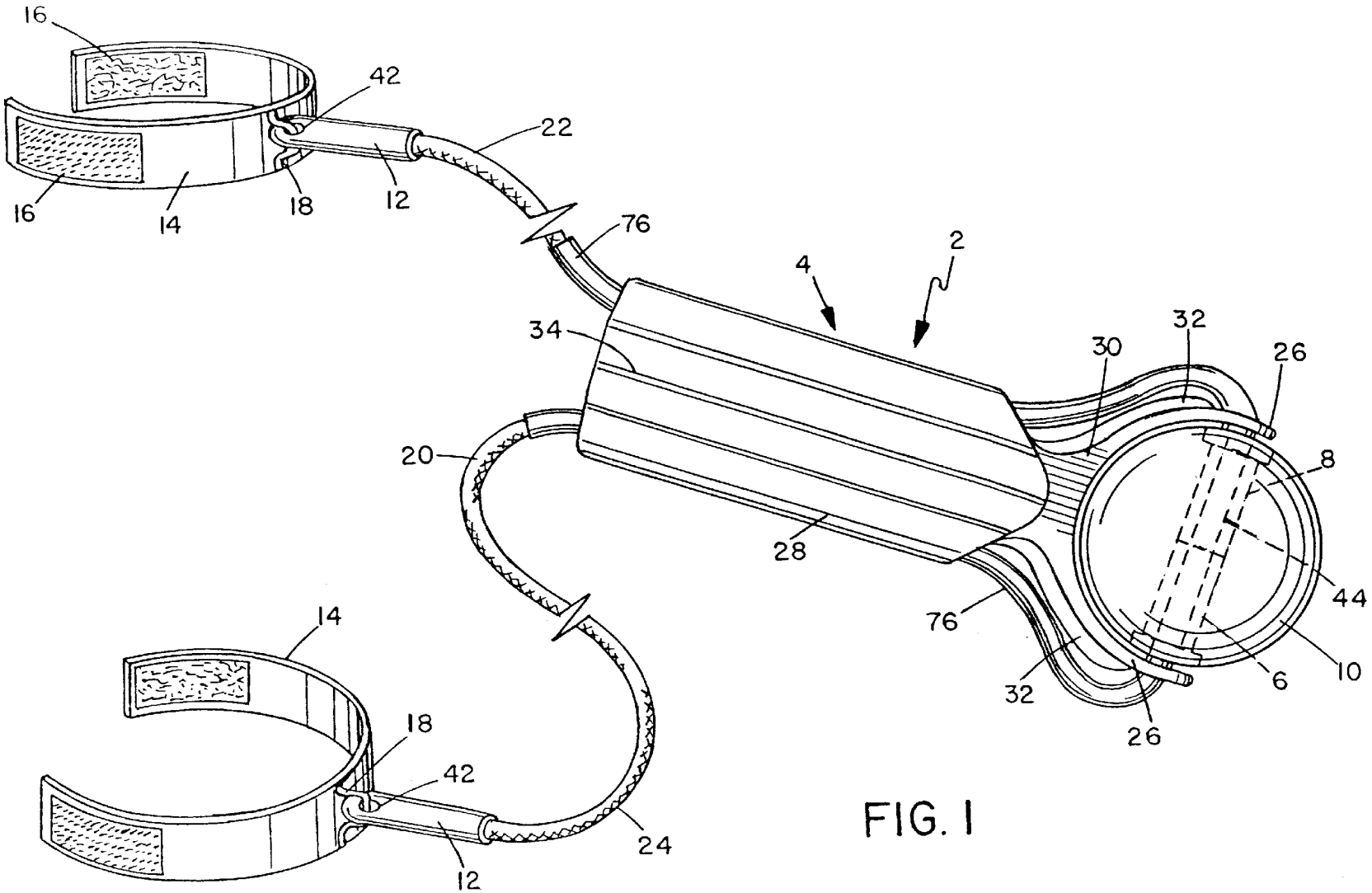
FIG. 1 is an illustration of the sports-ball striking training device of a preferred embodiment.
Figure 6:
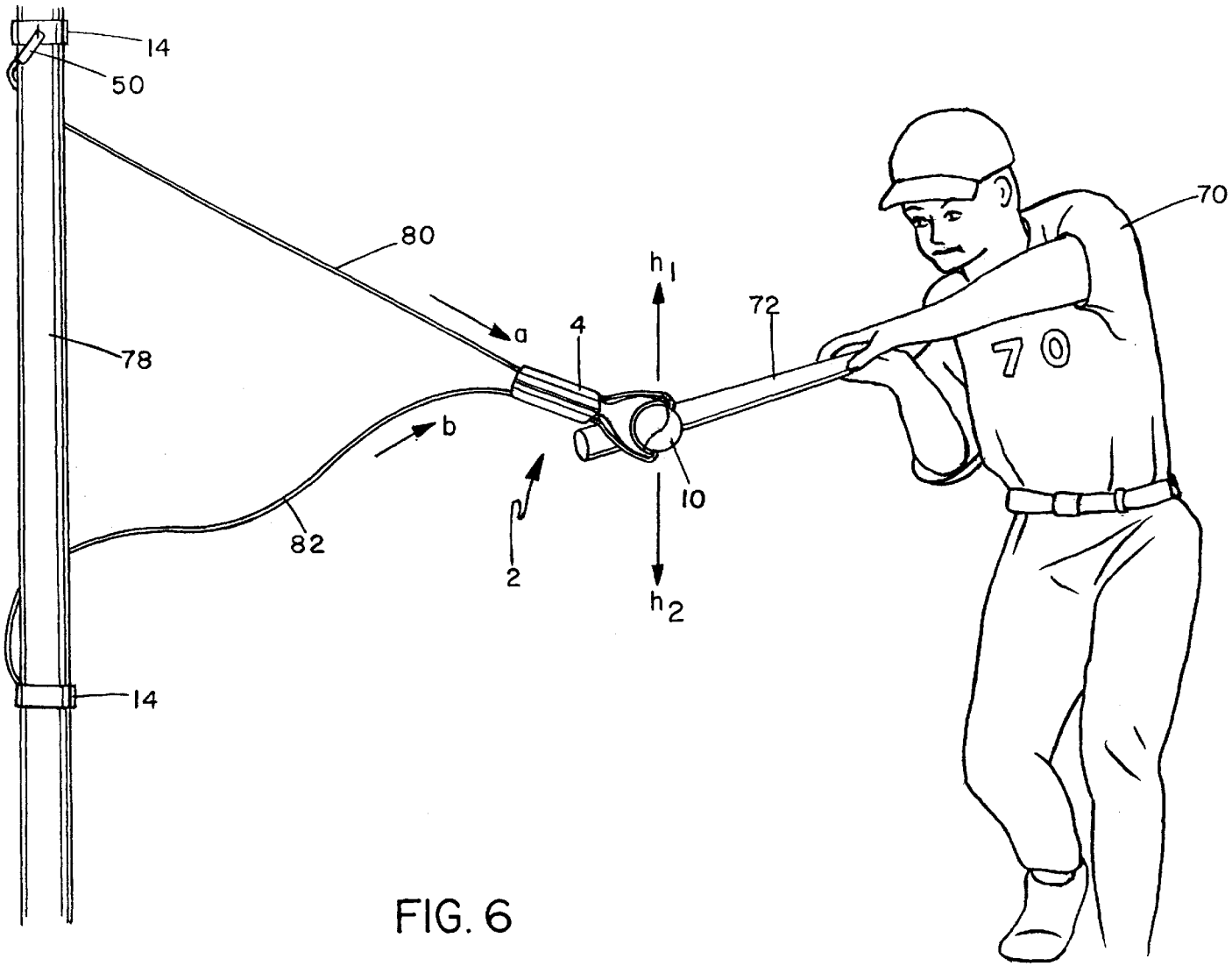
FIG. 6 illustrates a method for using the device and for adjusting the ball height.

FIGS. 1 and 6 illustrate a sports ball striking practice device 2 of a preferred embodiment of the present invention. The sports ball striking practice device includes a tether or cord 20 which is threadable through a rigid sleeve 4 and a ball insert 6, 8 inserted into a sports ball 10. The tether 20 is connected on a first end 22 and a second end 24 to end pieces 12. The end pieces 12 include openings 42 for accepting loops 18 or other similar devices that are attachable to straps or collar devices 14. The straps 14 of the preferred embodiment are removably mountable on a pole or tree 78, or any other suitable upright object, as shown in FIG. 6. Although FIG. 6, illustrates a baseball application, the sports ball striking practice device 2 may be used for striking practice of a variety of sports balls such as baseballs, softballs, tennis balls, hand balls, and racket balls with striking instruments such as rackets, bats, or one's hand.

Continuing with FIG. 6, the sports ball striking practice device 2 provides the sports enthusiast 70 with a convenient means for practicing his or her striking techniques. For a baseball or softball application, the first strap device 14 preferably is attached to a pole 78 at a height above the user's waist, e.g., approximately head height, and the second strap device 14 is attached to the pole 78 at a height lower than the user's waist. The height of the ball 10 is adjusted to the desired height, that is within a "strike zone", which is often defined as having an upper limit of midway between the top of the shoulders and the top of the uniform pants, and a lower limit just below the knee cap. As illustrated in FIG. 6, the height of the ball is adjusted upward $h_1$ by pulling the upper cord 80 through the sleeve 4 and ball 10 in direction "a". The height of the ball is adjusted downward $h_2$ by pulling the lower cord 82 through the sleeve 4 and ball 10 in direction "b". To start the striking practice, the user sets the ball in motion by either throwing the ball 10 forward, or releasing and immediately hitting the ball 10. For applications where the ball is kicked, the sports ball striking practice device 2 is placed lower on the pole 78.

The user 70 strikes the ball 10 causing the ball 10, the sleeve 4, and tether 20 to wrap around the pole 78. Once the ball 10, sleeve 4, and tether 20 have wound around the pole 78 completely, the force generated by the strike reverses direction, and the ball 10 unwinds to return the ball 10 to substantially the same position from where it was struck. The winding and unwinding of the ball 10 allows the user 70 to hit the ball 10 repeatedly. The sports ball striking practice device 2 simulates pitches thrown to a normal striking position, and provides realistic hitting resistance and flight of the ball after being struck. In addition, the sport ball striking practice device 2 may be used for either left-handed or right-handed hitting since the direction of wrapping is inconsequential to the operation of the sports ball striking training device 2.

Referring again to FIG. 1, the tether 20 of the preferred embodiment is made from a suitably elastic material, such as solid polyurethane tubing which provides a smooth exterior surface for facilitating the threading of the tether through the sleeve 4 and ball 10. The elasticity of the tether 20 stores the kinetic energy of the struck ball 10 for aiding in returning the ball 10 to the original target position. Other suitable materials which retain sufficient rigidity and elasticity also may be used for the tether 20.

As discussed above, prior art systems which connect the ball to the end of a tether, or systems which utilize a detached sleeve, present the opportunity for the tether to get caught on or around the striking instrument whenever the user completely or partially misses the ball, and instead strikes the tether. The mishit and subsequent wrap or misdirection of the tether often results in a stop in the flow of the wrapping/unwrapping of the ball and tether, and may cause the striking device, such as a bat to be pulled from the grip of the user. Thus, repeated mishits prevent the user from developing a rhythm to his or her practice sessions. Also, mishits add to the frustration of the user as he or she must catch the mishit ball and reposition himself/herself, and possibly adjust the height of the ball, before beginning the striking practice once again.

The sports ball 10 of the preferred embodiment is held by the cord 20 between arms or claws 26 of a rigid sleeve 4, as shown in FIG. 1. The rigid sleeve 4 acts to extend the sports ball 10 lengthwise, and provides an important margin of error for striking the ball. This feature of the present invention is of particular use for young and beginning players who have not developed the coordination and the skill to hit the ball 10 on center. If the sleeve is struck, the ball 10 and sleeve 4 continue the wrapping process around the pole 78.

Figure 2:
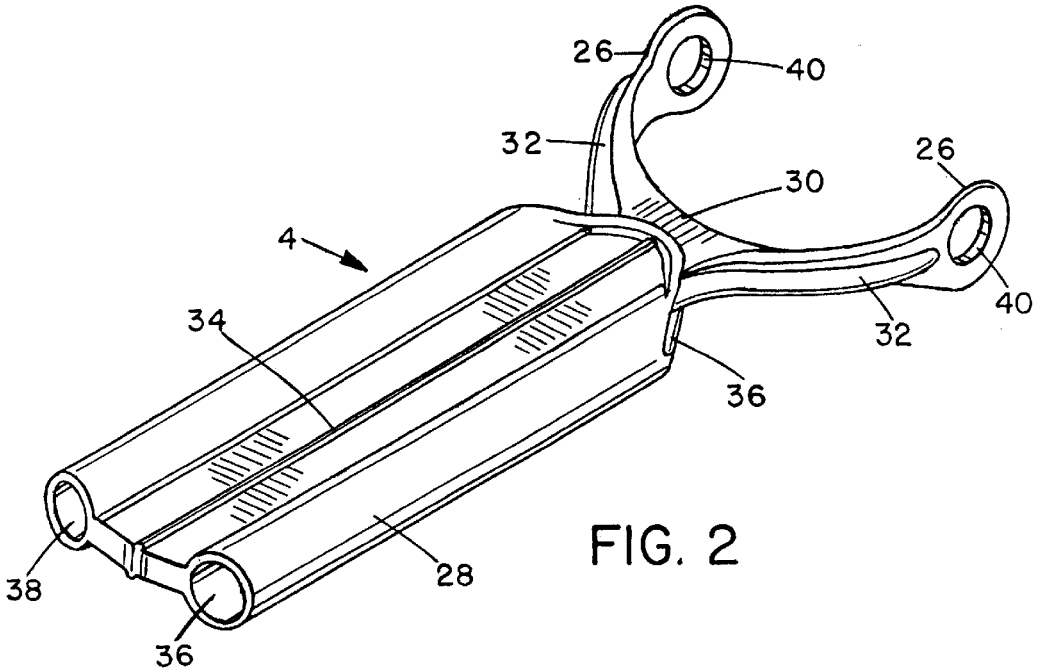
FIG. 2 is a perspective view of the rigid sleeve of a preferred embodiment.
Figure 3:
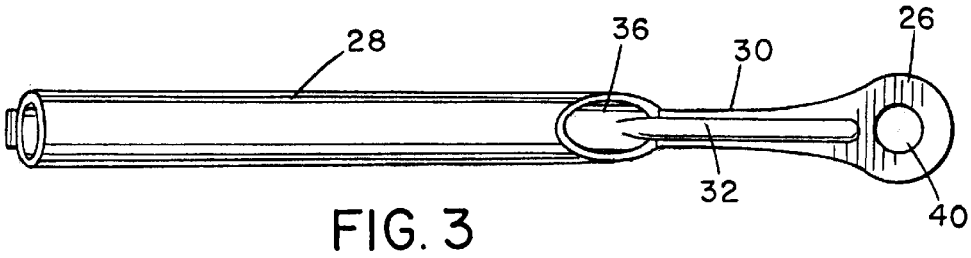
FIG. 3 is a side view of the rigid sleeve of a preferred embodiment.

The sleeve 4 of the preferred embodiment is a mold-injected single unit. The material utilized is a toughened nylon, however, any suitably strong material may be utilized for the sleeve 4. FIG. 2 illustrates a perspective view of the sleeve, and FIG. 3 illustrates a side view of the sleeve. The sleeve 4 includes a body portion 28, a neck portion 30, and arm portions 26. The sleeve body 28 is, for example, approximately 7 inches (17.78 cm) in length to provide a sufficient extension of the sports ball 10, while allowing the tether 20, ball 10 and sleeve 4 to wind and unwind around the pole. It should be appreciated that a variety of sleeve lengths are possible, and may be chosen based upon the sports ball used and the length of the striking instrument.

The sleeve body 28 includes a first channel 36 and a second channel 38 for accepting and holding the cord 20. For a cord 20 of the preferred embodiment which has a diameter of 0.27 inches (0.69 cm), the diameter of the channels 36, 38 is approximately 0.4 inches (1.02 cm). The diameter difference is chosen to allow the cord 20 and end piece 12 to be thread through the channels 36, 38 to either adjust the height of the ball 10 or to replace the ball 10.

Continuing with FIGS. 2 and 3, the sleeve body 28 further includes a center portion to add width to the sleeve. The center portion is strengthened by including a center strengthening rib 34 having a different thickness than the center portion. The sleeve neck portion 30 is formed to allow the cord 20 to exit the channels 36, 38 and curve outside along the sleeve arms 26. The sleeve neck 30 is strengthened by using varying radius of the arms 26 and the arm ribs 32. The sleeve arms 26 of the preferred embodiment are spaced apart sufficiently to accept a ball 10 between the arms 26 while maintaining a space between the sports ball 10 and the arms 26. This allows the ball 10 to "float" between the arms 26 so that the feel of striking the ball 10 is as close as possible to that of a pitched ball. A rigid sleeve 4 for use with a baseball must have arms sufficiently spaced apart to accept a 9 inch (22.86 cm) circumference ball. A rigid sleeve 4 which accepts softballs must be spaced to accept either an 11 inch (27.94 cm) or 12 inch (30.48 cm) circumference ball. Sleeves may be manufactured for specific sports balls 10 or manufactured for a size range of balls 10.

The sleeve arms 26 include a hole 40 that is aligned with the ball insert 6, 8, as illustrated in FIG. 1, when the cord 20 is thread through the ball and holes 40. The diameter of the arm holes 40 is sufficient to allow the cord 20 and end piece 12 to pass through. The diameter of the arm holes 40 must have as close a fit as possible with the cord 20 in order to prevent slippage of the sleeve 4 when the ball 10 is struck. A cord 20 that has a sufficiently tight fit with the arm holes 40 will not slip due to the bend of the cord 20 through the arms holes 40 to the channels 36, 38.

An alternate embodiment of the invention that requires larger arm holes to accept a particular end piece 12 may further include rubber grommets (not shown) having a smaller diameter hole that are placed between the holes 40 and the sports ball 10. The smaller diameter of the grommets (not shown) provides the necessary friction to hold the sleeve 4 in place when the ball 10 is struck. The end piece 12 can be pushed through the rubber grommets (not shown) to thread the cord through the ball 10.

In another alternate embodiment of the invention, a section of tougher polyurethane tubing 76 may be placed over a center section of the cord 20, as illustrate in FIG. 1. The tubing 76 is mostly enclosed within the ball 10 and sleeve 4, with some of the tubing 76 protruding from the ends of the two sleeve channels 36, 38. For example, an 8 foot cord may include a 3 foot section of tubing 76. The tubing 76 protects the cord 20 from possible damage from the sleeve 4. The tighter fit created by the tubing 76 ensures that the cord 20 does not pull loose from the arm section 26 of the sleeve 4. The tighter fit provided by the tubing 76 also improves the holding power of the height adjustment of the ball. In addition, the tubing 76 dampens the sound from the strike, and gives the practice device 2 added spring back characteristics when it wraps around the pole 78. The later advantage is important when the sports ball striking training device 2 is used by young children who cannot hit the ball 10 hard.

FIG. 1 illustrates the ball insert 6, 8 of the preferred embodiment. Prior art practice striking devices simply insert a cord into a channel drilled through the ball. Over time, strikes to the ball collapse the drilled hole, making it difficult to adjust the cord. In addition the integrity of the ball diminishes because the ball shape changes and the ball interior breaks down. The preferred embodiment of the present invention utilizes a ball insert 6, 8 to provide a channel 44 for the cord 20 which will not collapse over time with the repeated striking of the sports ball 10. In addition, the ball insert 6, 8 maintains stability of the core of the sports ball 10 to extend the wear and life of the ball 10.

Continuing with FIG. 1, the ball insert 6, 8 is friction fit and/or glued into the channel 44 of the sports ball 10. The ball insert 6, 8 may be a single piece that spans the diameter of the sports ball 10. Alternatively, the ball insert 6, 8 may consist of a first ball insert 6 that is inserted into a first end of the channel 44, and a second ball insert 8 that is inserted into a second end of the channel 44. The ball insert 6, 8 may be used for any ball having a solid core. For applications of the sports ball striking training device 2 which holds non-solid core balls 10, e.g., soccer balls, the ball insert 6, 8 must be sealed at the exterior of the ball to maintain air in the ball.

Figure 5:
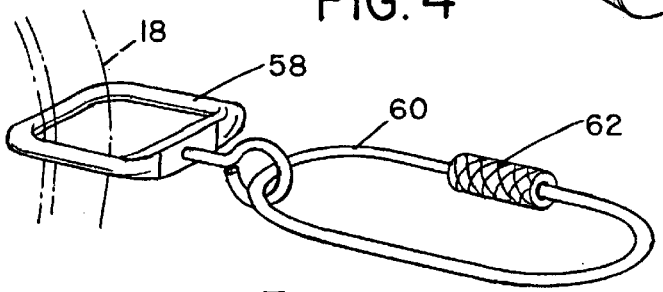
FIG. 5 shows an alternate embodiment of a openable clasp for accepting a chord end piece.

FIG. 1 illustrates end pieces 12 that may be used with the sports ball striking practice device 2. As illustrated, these end pieces 12 are permanently attached to the straps 14 so that the ball cannot be replaced. FIG. 5 illustrates a hook and clasp embodiment that is attachable to the strap loop 18 that allows replacement of the sports ball 10. The hook device 58 is permanently attached to the strap 14 through the strap loop 18 that is sewn to the strap 14 during manufacture. The hook device 58 accepts an openable clasp 60. A locking mechanism 62 may be opened to accept the end piece hole 42 of the end piece 12. The locking mechanism 62 is then locked to prevent the cord end piece 12 and cord 20 from disengaging from the strap device 14. To provide the capability to replace the sports ball 19, it is necessary for only one of the end pieces 12 to be attached to a hook and clasp-type assemble since the cord 20 and end piece 12 may be thread through the first channel 36, the arm hole 40, the replacement ball 10, the opposite arm hole 10, and the second channel 38.

Figure 4:
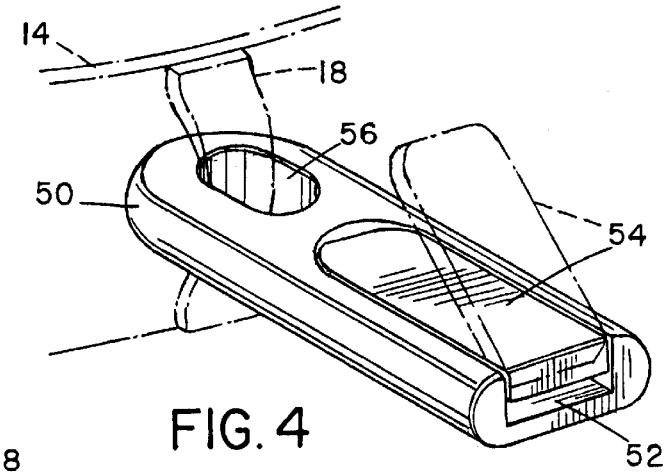
FIG. 4 is an illustration of a preferred embodiment of self-clinching cam end piece.

FIG. 4 illustrates a preferred self-cinching cam end piece 50 of the preferred embodiment of the present invention. The self-cinching cam end piece 50 replaces at least one of the end pieces shown in FIG. 1. The self-cinching cam end piece 50 has a strap hole 56 for permanently attaching it to the strap loop 18 of the strap 14. The self-cinching cam end piece 50 includes an openable/closeable cam mechanism 54 which closes onto and cinches a cord end 22 that is inserted into a cam opening 52. Although FIG. 4, illustrates a rectangular opening, it should be appreciated that the self-cinching cam 50 may have a variety of shapes that may include a circular opening 52.

The self-cinching cam 50 of the preferred embodiment allows the cord 20 to be attached and detached from the strap 14 providing easy threading of the cord 20 for replacement of the sports ball 10. The use of the self-cinching cam 50 allows for uniform diameters of the sleeve channels 36, 38, the arm holes 40, and the ball insert 6, 8 since the diameter of the cord 20, alone, determines the necessary diameters of the device components 36, 38, 40, 6, 8. For example, a cord diameter of the preferred embodiment of 0.27 inches (0.69 cm) together with a diameter of the arm holes 40 of 0.4 inches (1.02 cm) provides a sufficient friction fit to keep the sleeve 4 from slipping during the striking of the sports ball 10.

FIG. 1 illustrates adjustable velcro bindings or straps 14 of the preferred embodiment of the present invention that are easily attached to and removed from a vertical object such as a pole or tree 78. Other embodiments of the invention may use other detachable or permanent collar or strap devices for attachment of the practice striking device 2 the vertical object 78. Any combination of hooks 58, clasps 60, end pieces 12, 50, and straps 14 may be used to hold the cord ends 22, 24 of the present invention. Thus, the cord 20 and rigid sleeve 4 combination of the preferred embodiment of the present invention may be used in place of the ball and tethers of other prior art devices.

Although a preferred embodiment of the invention has been described above by way of example only, it will be understood by those skilled in the field that modifications may be made to the sports ball striking training device without departing from the scope of the invention, which is defined by the appended claims.

We claim:

1. A sports ball striking training device for attachment to a vertical object, the device comprising:

a sports ball having a ball channel;

a sleeve comprising:

a sleeve body having a first channel and a second channel; and a first sleeve arm and a second sleeve arm extending from the sleeve body, the first and second sleeve arms separated to accept the sports ball therebetween;

a cord having a cord first end and a cord second end, wherein at least one of the cord first end and the cord second end is threadable through the first channel, the first arm, the ball channel, the second arm, and the second channel to hold the sports ball between the first and second sleeve arms; and a first and second attachment means for attaching the cord first and second ends to the vertical object.

2. The sport ball striking training device as in claim 1, further comprising at least one end piece attached to at least one of the cord first end and the cord second end, wherein the at least one end piece is detachable from one of the first and second attachment means.

3. The sport ball striking training device as in claim 2, wherein the at least one end piece is threadable through the first channel, the first arm, the ball channel, the second arm, and the second channel.

4. The sport ball striking training device as in claim 2, wherein the at least one end piece comprises a cam means for releasably accepting one of the cord first end and the cord second end.

5. The sport ball striking training device as in claim 1, wherein the first and second attachment means comprises a first strap and a second strap.

6. The sport ball striking training device as in claim 1, further comprising a ball insert for insertion into the ball channel.

7. The sport ball striking training device as in claim 6, wherein the ball insert comprises a first insert piece for insertion into a first end of the ball channel, and a second insert piece for insertion into a second end of the ball channel.

8. The sport ball striking training device as in claim 6, wherein the ball insert forms a seal between an exterior surface of the sports ball and the ball insert.

9. The sport ball striking training device as in claim 1, wherein the sleeve is a rigid sleeve.

10. The sport ball striking training device as in claim 9, wherein the sleeve is a toughened nylon.

11. The sport ball striking training device as in claim 1, wherein the first sleeve arm and the second sleeve arm are adjustable to accept a plurality of sports ball types.

12. The sport ball striking training device as in claim 1, further comprising a tubing for covering a center portion of the cord.

13. The sport ball striking training device as in claim 1, wherein a height of the sports ball is adjusted by sliding a portion of the cord through the sleeve and sports ball.

14. A device for striking practice of a sports ball, the device comprising:

a sleeve comprising:

a sleeve body having a sleeve channel; and a first sleeve arm and a second sleeve arm extending from the sleeve body, the first and second sleeve arms separated to accept the sports ball for attachment therebetween;

a cord having a cord first end and a cord second end, wherein at least one of the cord first end and the cord second end is threadable through the sleeve channel, wherein the cord is slidable in the sleeve channel to adjust a position of the sports ball; and a first and second attachment means for attaching the cord first and second ends to a substantially vertical object;

wherein the sports ball wraps around the substantially vertical object when struck, then unwinds to present the sports ball for repeated striking.

15. The device for striking practice as in claim 14, wherein the sleeve channel comprises a first sleeve channel and a second sleeve channel.

16. The device for striking practice as in claim 15, wherein the sports ball comprises a ball channel, and wherein the cord is further threadable through the first sleeve channel, the ball channel, and the second sleeve channel for suspending the sports ball therebetween.

17. The device for striking practice as in claim 14, wherein the cord further comprises a center section having a larger cord diameter.

18. The device for striking practice as in claim 17, wherein the center section comprises tubing.

* * * * *